US005323684A

United States Patent [19]

Umphries

[11] Patent Number: 5,323,684

[45] Date of Patent: Jun. 28, 1994

[54] DOWNHOLE CHARGE CARRIER

[76] Inventor: Donald V. Umphries, P.O. Box 9802, New Iberia, La. 70560

[21] Appl. No.: 864,420

[22] Filed: Apr. 6, 1992

[51] Int. Cl.[5] ..... E21B 43/117

[52] U.S. Cl. ..... 89/1.15; 175/4.6

[58] Field of Search ..... 89/1.15; 175/4.6, 4.57; 166/55.1

[56] References Cited

U.S. PATENT DOCUMENTS

| | | | |
|---|---|---|---|
| 4,552,234 | 11/1985 | Revett | 175/4.6 |
| 4,773,299 | 9/1988 | Oestreich et al. | 89/1.15 |
| 4,844,170 | 7/1989 | Gill | 175/4.6 |
| 4,960,171 | 10/1990 | Parrott et al. | 175/4.6 |
| 5,054,564 | 10/1991 | Oestreich et al. | 166/55.1 |

*Primary Examiner*—David H. Brown
*Attorney, Agent, or Firm*—Matthews and Assoc.

[57] ABSTRACT

This invention discloses downhole explosive carriers in which the explosive charges are mounted in a unique staggered spiral pattern thereby allowing a greater number of shots that can be fired per unit length while increasing the spacing between explosive charges; the latter advantage further reduces the potential interference between fired shots and pressure change therefore providing a greater perforated hole size. With a 3½-inch gun perforating through a 4½- to 5-inch casing, one trip of the present invention downhole provides as much or greater flow area than what could be achieved by two trips of a conventional gun, while eliminating the risk of splitting the casing which can be caused due to multiple shooting. With a 3⅜-inch gun perforating a 5-inch trip of the current invention equals two trips of a conventional gun of the same size, plus a 10% improvement in flow rate.

12 Claims, 3 Drawing Sheets

DOWNHOLE CHARGE CARRIER

BACKGROUND OF THE INVENTION

This invention relates to an explosive carrier for the perforation of downhole casing and the penetration of earth formation therefrom, during oil and gas production operations.

In oil and gas operations, perforating through casing using a perforating gun is probably the most important of all completion jobs in cased holes. After a casing is properly placed in a drilled hole, a charge carrier carrying explosive charges are lowered downhole. Charges are fired to effectuate perforations through the steel casing and into the earth formation therefrom, thereby providing communications between the well bore and the desired producing zones.

In conventional charge carriers, the explosive charges are arranged in a spiral configuration. For 4½" to 5½" casings, two sizes of charge carriers are commercially available: 2⅞-inch and 3⅜-inch. To minimize interference between filed charges, the explosive charges in the conventional carriers are spaced at a 60 degrees phasing and at a vertical distance of about 2 inches. Such a conventional configuration results in a shot density of 6 shots per foot. Because of such a limited spacing, a certain extent of interference exists between the fire of shots. Due to the pressure wave generated by neighboring shots, the hole size is often significantly smaller than what could be achieved if no such interference existed.

With a conventional charge carrier, in order to achieve a desired flow rate, the same cased hole often has to be shot twice. The charge carrier is first lowered to the wellbore, and shots are fired. Then the carrier is pulled back to the surface, to reload charges. The charge carrier then is lowered again to the wellbore and shots are refired. Safety could be a serious concern in doing such multiple trip operations. Some explosives may not have been fired and could explode at the surface and cause serious safety concern. Furthermore, because the charge carrier must be lowered twice, this doubles the possibility that the carrier may get stuck in the pipe, requiring laborious fishing jobs. Multiple trips also consume significant rig time, which could be very expensive, especially during offshore operations. If the charge carrier is not properly positioned in the second run, it could end up shooting the same hole twice, getting interference from previously fired shots. Yet, furthermore, a multiple shooting also has the risk of splitting the casing when two shots are fired together.

SUMMARY OF THE INVENTION

The primary object of the present invention is to provide an improved explosive charge carrier for the perforation of a downhole casing and the penetration of earth therefrom.

Another object of the present invention is to provide a downhole explosive charge carrier having improved pattern for mounting explosive charges which is capable of providing a higher shot density, i.e., greater number of shots per unit length, and/or increasing the hole size of each perforation, relative to the conventional charge carrier.

Yet another object of the present invention is to provide a downhole explosive charge carrier having an improved charge mounting pattern that will substantially reduce the pressure drop near the wellbore with minimum interference between perforation shots.

Yet another object of the present invention is to provide a downhole explosive charge carrier having an improved charge mounting pattern that will eliminate the need for multiple perforation trips into a well in order to achieve a desired cross-sectional flow area around the wellbore.

Yet another object of the present invention is to provide a downhole explosive charge carrier having an improved charge mounting pattern that will maintain casing integrity by eliminating the need for multiple perforation jobs through the same casing.

Yet another object of the present invention is to provide a downhole explosive charge carrier that will enhance safety, reduce rig time, minimize the need for fishing jobs, and eliminate the possibility of shooting the same hole twice while providing the same or better flow cross-sectional area from the wellbore.

In this invention, the explosive charges are arranged in a unique staggered spiraling configuration. The mounting pattern of the explosive charges is defined by the track of circumferential movements accompanied by axially downward as well as upward movements. This contrasts the spiral configuration of a conventional charge carrier, in which the mounting pattern of the explosive charges is defined by the track of circumferential movements accompanied by only axially downward movements. With the new mounting pattern disclosed in the present invention, the number of shots that can be fixed per unit length of a carrier gun is increased, while the spacing between fixed shots is actually increased to substantially reduce interference therebetween, resulting in greater perforated hole size. With a 3⅛-inch gun perforating through a 4½-inch to 5-inch casing, one trip of the present invention downhole provides as much or greater flow area than what could be achieved by two trips of a conventional gun. With a 3⅜-inch gun perforating a 5-inch casing, one trip of the current invention equals two trips of a conventional gun of the same size, plus a 10% increase in flow rate. Reducing the number of perforating jobs reduces rig time required for perforating and eliminates the need to reload the perforating gun. Therefore, not only perforating cost is saved but safety is greatly enhanced.

DETAILED DESCRIPTION OF THE PREFERRED EMBODIMENT

Figure 5:
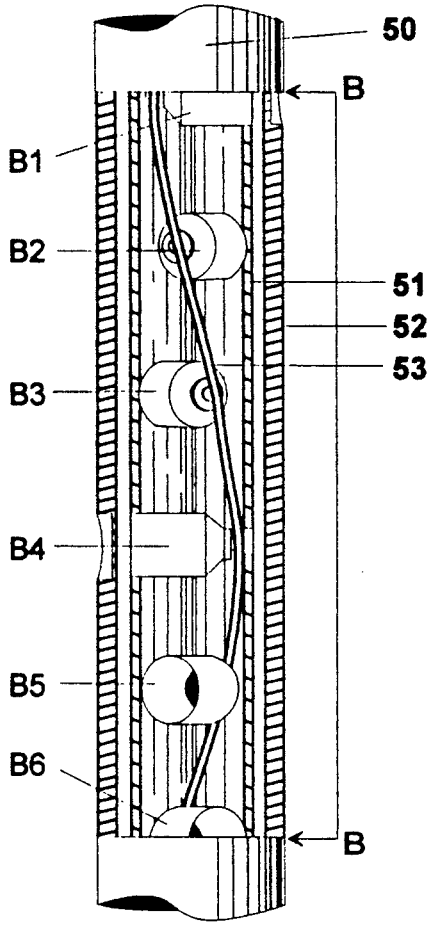
Fig. 5 (prior art)
FIG. 5 is a revealed view of a one-foot section, B—B, of a conventional hollow charge carrier.

Now referring to FIG. 5, which is a revealed view of a section of a conventional hollow carrier 50 showing an inner cylinder 51 movably sleeved inside an outer cylindrical shell 52. Charge holders B-1 through B-6 to hold explosive charges are mounted on the inner cylinder 51. The axial distance between points B—B is about 12 inches. Such a length is only for illustration purpose, other lengths are possible. The explosive charge holders B-1 through B-6 can be made of any suitable material such as mild steel, aluminum, cardboard, plastics or paper. Each explosive charge holder contains explosive charges of appropriate quantity and quality. The explosive charges are connected to a prima cord 53, which, in turn, is connected to a detonator, not shown, for remotely detonating the explosive charges when the detonator is fired.

Figure 8:
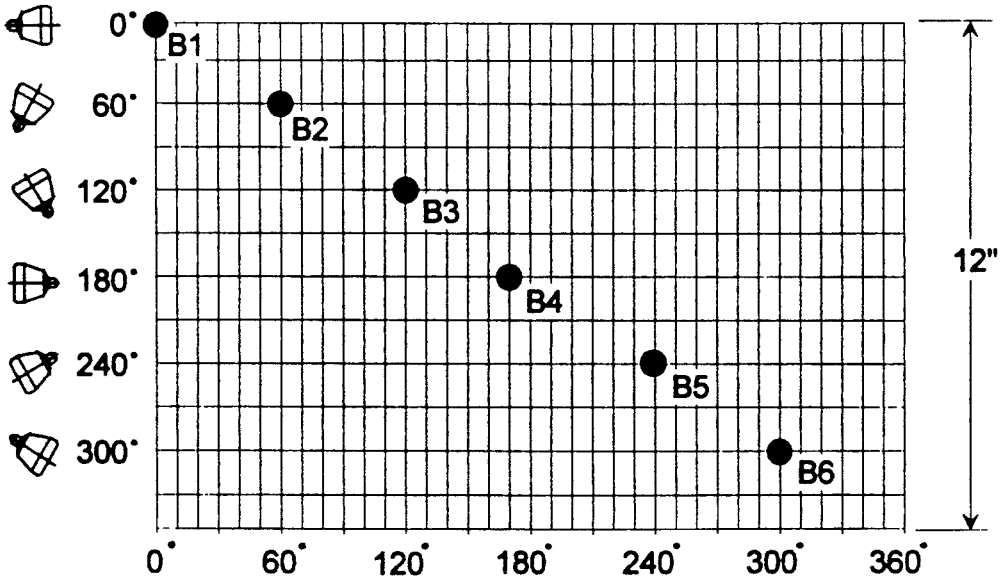
Fig. 8 (prior art)
FIG. 8 is an illustration of the relative circumferential and axial positions of the explosive charge holders in the one-foot section B—B of FIG. 5.

In the conventional hollow carrier as shown in FIG. 5, the explosive charge holders are arranged inside the hollow carrier in such a manner that they are separated both longitudinally and circumferentially in a spiral configuration in order to minimize the interference when the explosives are detonated. FIG. 8 shows the arrangement of the charges when they are projected onto a flat two-dimensional vertical surface. With a $2\frac{7}{8}$-inch or $3\frac{3}{8}$-inch carrier, the optimum arrangement is to space the charges circumferentially at a 60 degrees phasing (i.e., the charges are separately circumferentially at a 60-degree angle), and at an axial distance of about 2 inches. Such an arrangement results in a maximum shot density of 6 six shots per foot. For a smaller diameter carrier, the explosive quantity in each charge holder may need to be decreased in order to maintain the same pattern, resulting in smaller holes. If the same explosive quantity is to be used either the circumferential phasing or the axial charge separations must be increased, resulting in lesser number of perforation shots per foot. For a larger diameter carrier, either the explosive quantity per holder can be increased, or the shot density can be increased, or both.

Figure 6:
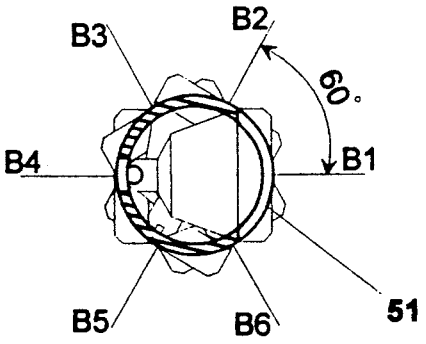
Fig. 6 (prior art)
FIG. 6 is a top view of the one-foot section B—B of FIG. 5, showing only the inner cylinder with a plurality of explosive charge holders mounted thereon.
Figure 7:
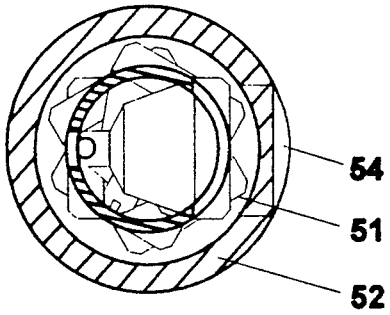
Fig. 7 (prior art)
FIG. 7 is a top view of the one-foot section B—B of FIG. 5, showing both the inner cylinder and the outer cylindrical shell.

FIG. 7 is a top view of Section B—B of the conventional hollow carrier showing both the inner cylinder 51 and the outer cylindrical shell 52; whereas FIG. 6 shows only the inner cylinder 51 of the hollow carrier 50 with explosive charger holders mounted thereon. FIG. 7 shows that the portion of the outer cylinder 52 corresponding to radially outwardly projected area from the charger holder is "scalloped" (i.e., the wall is made thinner) 54 to reduce resistance that the explosive charge must penetrate during hole perforation. FIG. 6 shows that the charge holders are arranged in a counter-clockwise manner, each charger holder is positioned at about sixty degrees from its immediately upper charger holder. FIGS. 5 through 8 indicate that the charge holders B-1 through B-6 are stacked, with a 60-degree circumferential phasing and a two-inch axial separation, on top of each other in an orderly manner.

Figure 1:
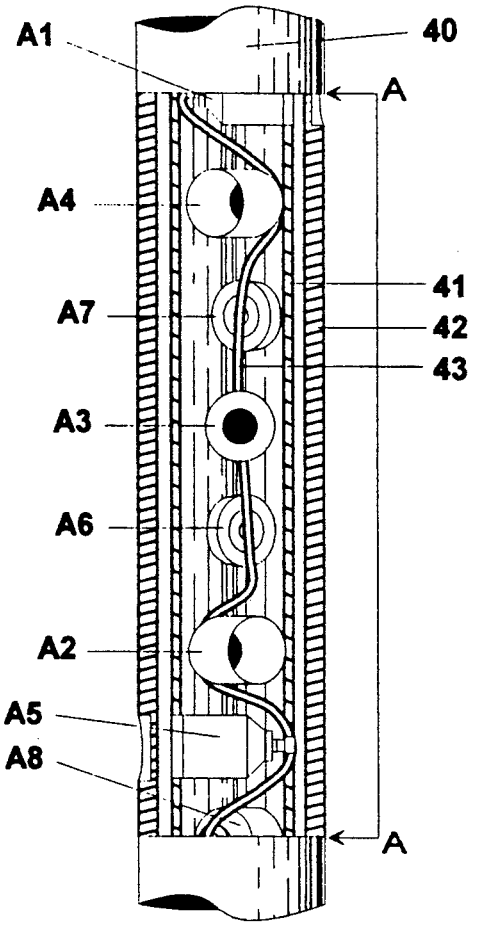
FIG. 1 is a revealed view of a one-foot section, A—A, of the hollow charge carrier of this invention.

Now referring to FIG. 1, which is a revealed view of a section of a preferred embodiment of the hollow carrier of this invention The hollow carrier has a $3\frac{1}{8}$-inch or $3\frac{3}{8}$-inch diameter. However, it is to be noted that the principle disclosed in the present invention can be equally applicable to other charge carriers of different construction and sizes. The axial distance between points A—A is also 12 inches. FIG. 1 also shows an inner cylinder 41 placed within an outer cylindrical shell 42, similar to a conventional carrier as shown in FIG. 5. Explosive charge holders A-1 through A-8 are mounted on the inner cylinder. A prima cord 43 runs through the explosive charges contained in the charge holder. In FIG. 1, the charge holders are in a staggered spiral configuration, which can be best illustrated in FIG. 4. FIG. 4 is a again a two-dimensional presentation of the relative position of the charge holders projected onto a flat vertical surface. In the spiral configuration of a conventional charge carrier, the mounting pattern of the charge holders is defined by the track of circumferential movements accompanied by axially downward movements. On comparison, in the staggered spiral configuration of this invention, the mounting pattern of the charge holders is defined by the track of circumferential movements accompanied by axially downward as well as upward movements.

Figure 3:
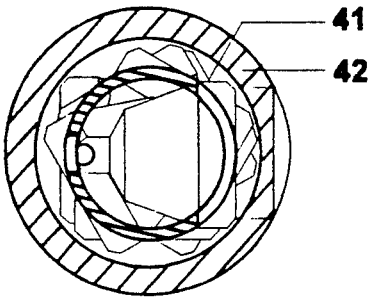
FIG. 3 is a top view of the one-foot section A—A of FIG. 1, showing both the inner cylinder and the outer cylindrical shell.
Figure 4:
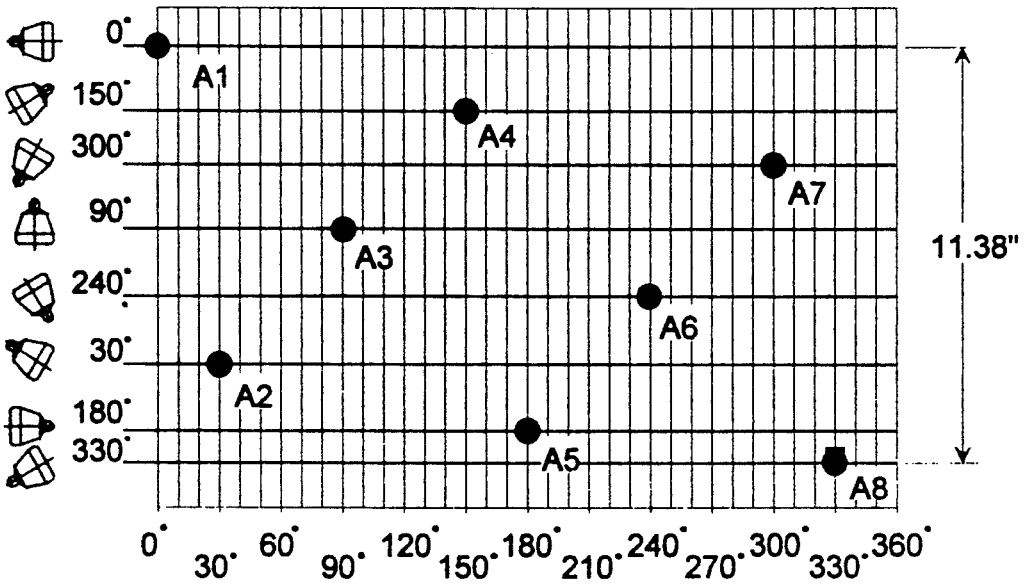
FIG. 4 is an illustration of the relative circumferential and axial positions of the explosive charge holders in the one-foot section A—A of FIG. 1.

In the preferred embodiment as shown in FIG. 4, charge A-1 is mounted at a circumferentially zero degree position, i.e., the reference position. Charge A-2, instead of being 60 degrees counter-clockwise from charge A-1 as would be in the convention carrier, is 30 degrees clockwise from charge A-1. The axial distance between charges A-1 and A-2, however, is substantially greater than the 2 inches spacing in the conventional carrier. The axial separation between charges A-1 and A-2 is about 9 inches. Charge A-3 is about 60 degrees clockwise from charge A-2, whereas, the axial distance therebetween is reduced by more than half, relative to the axial distance between charges A-1 and A-2, to 3.5 inches. This distance, however, still provides greater separation than in the conventional carrier. FIG. 4 further shows that charge A-4 is 60 degrees clockwise from charge A-3, and the axial separation between charges A-3 and A-4 is similar to that between charges A-2 and A-3. The pattern for mounting charges A-2 through A-4 is repeated to mount charges A-5 through A-7. That is, Charge A-5 is mounted at about 30 degrees clockwise from charge A-4, with a large downward movement therefrom. Charge A-6 is mounted at 60 degrees clockwise from charge A-5, with a relatively mild upward movement. Charge A-7 is again at 60 degrees clockwise from charge A-6, also with a relatively mild upward movement. Charge A-8 is mounted at 30 degrees clockwise from charge A-7, with a large vertically downward movement. Such a staggered spiral configuration of this invention allows a similar $3\frac{1}{8}$-inch carrier to provide between seven to eight shots per foot. In the preferred embodiment as shown in FIG. 1 through 4, the average shot density is 7.4 shots per foot. Furthermore, since the separation between the charges is actually greater than that in the conventional carrier, less interference is expected between fired shots, resulting in a larger hole size. For a $3\frac{1}{8}$ carrier, the perforated hole size from the present invention is 0.70", compared to 0.60" from a conventional $2\frac{7}{8}$ carrier. This represents a 100% improvement over the conventional carrier.

Figure 2:
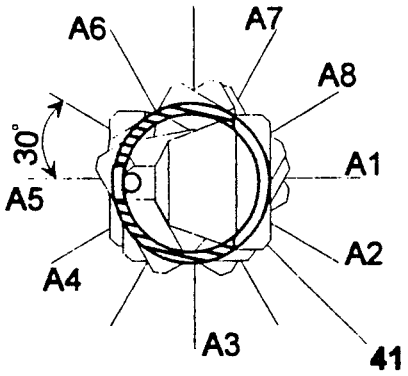
FIG. 2 is a top view of the one-foot section A—A of FIG. 1, showing only the inner cylinder with a plurality of explosive charge holders mounted thereon.

FIGS. 2 and 3 show a top view of Section A—A of the hollow carrier of the present invention. FIG. 3 shows both the inner cylinder 41 and the outer cylindrical shell 42, whereas, FIG. 2 only shows the inner cylinder 41 with the charge holders A-1 through A-8. In FIG. 2, it is shown that the second charge from the top, or charge A-4, is at 150 degrees from charge 1. Next down, charge A-7 is at 300 degrees from charge In a successfully downward manner, charges A-3, A-6, A-2, A-5, A-8 are at 90, 240, 30, 180, and 330 degrees, respectively, from charge A-1.

An illustration of the advantages of the present invention can be shown in Example 1.

EXAMPLE 1

In a newly drilled well, perforations were conducted through a 5-inch P-110 casing using both the hollow carrier gun of this invention and a conventional carrier gun. In all tests the reservoir pressure is 4,000 psig. Both types of hollow charge carriers are 3⅜ inches in diameter. With the hollow carrier of this invention, the shot density was 7.4 shots per foot. The average perforated hole size is 0.69 inches, resulting in a total area of 2.77 square inches. With the conventional hollow carrier, two trips were made, that is, the gun was fired once, pulled back to the surface, reloaded with explosive charges, lowered to downhole again, and fired again. The conventional gun has six shots per foot, resulting in a nominal 12 shots per foot after two perforation trips. The average hole size is 0.453 inches, resulting in a total flow area of 1.93 square inches. Table 1 shows the required pressure drawdowns at various liquid flow rates for these two types of hollow carrier guns.

TABLE 1

Comparison of Test Results
Between the Present Invention (One Trip)
and a Conventional Charge Carrier
RESERVOIR PRESSURE CONSTANT AT 4000 PSIG
CASING - 5" P-110

| | This Invention (one trip) SHOT DEN = 7.4 PERF DIA = 0.69 IN. TOTAL AREA = 2.77 SQ. IN | | Conventional Charge Carrier (two trips) SHOT DEN = 12 PERF DIA = 0.453 IN. TOTAL AREA = 1.93 SQ. IN. | |
|---|---|---|---|---|
| LIQ. RATE (bbl/d) | IPR (FBHP) (psig) | TOTAL DRAWDOWN (PR-FBHP) (psi) | IPR (FBHP) (psig) | TOTAL DRAWDOWN (PR-FBHP) (psi) |
| 100.00 | 3985.6 | 14.4 | 3984.3 | 15.7 |
| 200.00 | 3970.0 | 29.2 | 3968.0 | 32.0 |
| 300.00 | 3955.8 | 44.2 | 3951.1 | 48.9 |
| 400.00 | 3940.4 | 59.6 | 3933.6 | 66.4 |
| 500.00 | 3924.7 | 75.3 | 3915.4 | 84.6 |

Figure 9:
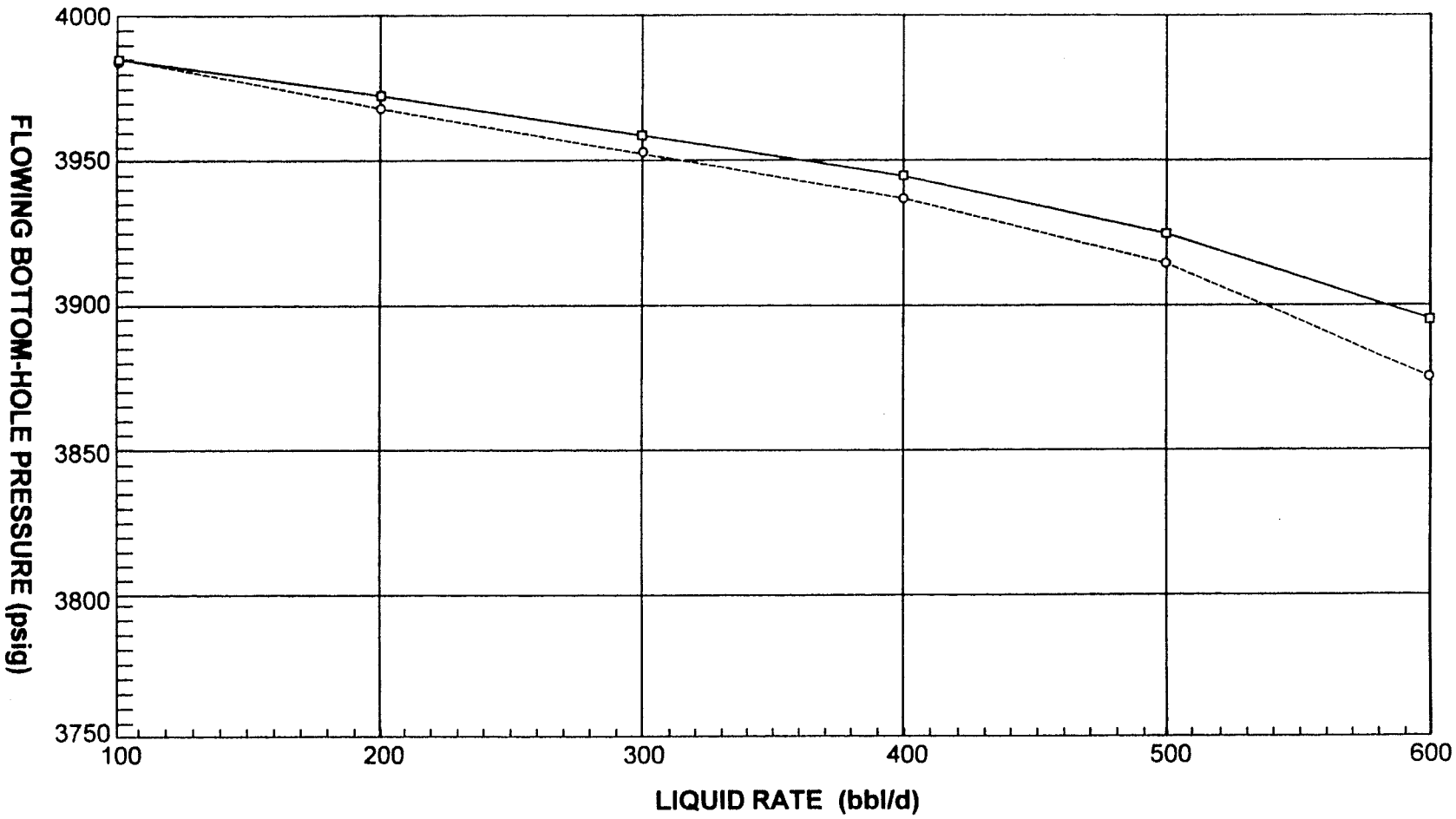
FIG. 9 is a comparison of test results from the hollow carrier of the present invention and a conventional hollow carrier.

The same data are plotted in FIG. 9. The charge load is grams per charge for the hollow carrier of the present invention, compared to 23 grams for the conventional hollow carrier. The reason that a smaller charge load of the present invention actually resulted in a greater hole size than the conventional carrier gun is because the spacing between charges of the present invention is substantially greater than that in the conventional carrier, resulting in substantially reduced interference, which could be caused in part by the pressure wave generated by previously fired or neighboring shots. The effect from pressure waves is inversely proportional to the distance raised to its third power. Greater separation between charges of this invention reduced the effect of pressure wave and provided a greater hole diameter, even though less charge load was used. The test results shown in Table 1 and FIG. 9 indicate that one trip of the present invention downhole provides a much or greater flow area than what could be achieved by two trips of a conventional gun. By using the present invention, the operator will be able to reduce rig time required for perforation by one-half, and eliminate the possibility of shooting the same hole twice, or getting interference with previous shots. Since only one trip is required with the present invention, the charge carrier does not have to be brought back to the surface and reloaded. Safety, therefore, is greatly enhanced. Furthermore, since only one trip is required, this also greatly minimizes the possibility of having to do fishing jobs, which can be necessitated by a stuck charge carrier in the pipe. Furthermore, this present invention also eliminates the risk of splitting the casing, which can be caused due to multiple shooting.

Although the best mode contemplated for carrying out the present invention has been herein shown and described, it will be apparent that modification and variation may be made without departing from what is regarded to as the subject matter of the invention.

What is claimed is:

1. A substantially cylindrically-shaped charge carrier for carrying explosive charges, said charge carrier having an outer diameter of less than 3.5 inches and having a longitudinal axis and said explosive charges having a density of at least 7 shots per axial foot and being contained in a plurality of explosive charge holders which are spaced apart both longitudinally and circumferentially to maximize the distance between a fixed number of shots per unit length, said explosive charges being arranged in a staggered spiraling configuration by which said explosive charges are more distantly spaced from each other than would be an equal number of charges in an unstaggered spiraling configuration thereby allowing the circumferential distance between these explosive charge holders to be smaller than that would be required in an unstaggered spiraling configuration therefore increasing the number of explosive charge holders that can be carried by said charge carrier per unit length thereof relative to an unstaggered spiraling configuration.

2. The charge carrier of claim 1 wherein said charge carrier is a hollow carrier which comprises:

(a) an inner cylinder having a plurality of apertures which are spaced apart both longitudinally and circumferentially and arranged in a staggered spiraling configuration;

(b) a plurality of explosive charge holders mounted through said apertures on said inner cylinder, said explosive charge holders containing explosive charges therein and said explosive charge holders being connected to a prima cord which is connected to a detonator for detonating said explosive charges when the detonator is fired; and (c) an outer hollow cylinder enclosing both said inner cylinder and said explosive charge holders for retaining debris which may be produced when said explosive charges are detonated.

3. The charge carrier of claim 2 wherein said explosive charge holders being shape charges.

4. The charge carrier of claim 2 wherein said outer hollow cylinder contains a plurality of recesses disposed at substantially the same locations as but radially outwardly of said explosive charges to reduce resistance to be exerted by said outer hollow cylinder when said explosive charges are detonated.

5. The charge carrier of claim 1 wherein said staggered spiral configuration being defined by incremental changes in said charge holder's positions, said incremental changes comprising:

(a) a directionally constant circumferential increment; and (b) repeated sequences of downward and upward longitudinal increments.

6. The charge carrier of claim 5 wherein said sequence of longitudinal increments comprising one downward increment followed by two upward increments, wherein said downward increment encompassing a greater longitudinal distance than the sum of said two upward increments, and wherein said downward increment being accompanied by a smaller circumferential increment than either one of said upward increments.

7. The charge carrier of claim 6 wherein the circumferential increment accompanying said downward increment is 30° and the circumferential increment accompanying each of said upward increments is 60°.

8. The charge carrier of claim 7 wherein said outer cylinder having an outer diameter of 3⅛ inches.

9. The charge carrier of claim 8 wherein said charge carrier having a longitudinal density of said explosive charge holders between 7 and 8 per foot, each of said explosive charge holders being capable of creating a perforation of at least 0.62 inch diameter.

10. The charge carrier of claim 7 wherein said outer cylinder having an outer diameter of 3⅜ inches.

11. The charge carrier of claim 10 wherein said charge carrier having a longitudinal density of said explosive charge holders between 7 and 8 per foot, each of said explosive charge holders being capable of creating a perforation of t least 0.73 inch diameter.

12. A substantially cylindrically-shaped charge carrier for carrying explosive charges, said charge carrier having an outer diameter of less than 4.0 inches and having a longitudinal axis and said explosive charges having a density of at least 7 shots per axial foot and being contained in a plurality of explosive charge holders which are spaced apart both longitudinally and circumferentially to maximize the distance between a fixed number of shots per unit length, said explosive charges being arranged in a staggered spiraling configuration by which said explosive charges are more distantly spaced from each other than would be an equal number of charges in an unstaggered spiraling configuration thereby allowing the circumferential distance between these explosive charge holders to be smaller than that would be required in an unstaggered spiraling configuration therefore increasing the number of explosive charge holders that can be carried by said charge carrier per unit length thereof relative to an unstaggered spiraling configuration.

* * * * *